US005209250A

United States Patent [19]

Taeckens

[11] Patent Number: 5,209,250

[45] Date of Patent: May 11, 1993

[54] METHOD FOR ATTACHING AN ARTIFICIAL EXTENSION ON FINGERNAIL

[75] Inventor: Sandra D. Taeckens, La Quinta

[73] Assignee: Herbert C. Schulze

[21] Appl. No.: 740,293

[22] Filed: Aug. 5, 1991

[51] Int. Cl.[5] ..... A45D 29/00

[52] U.S. Cl. ..... 132/73; 132/73.5; 132/200

[58] Field of Search ..... 132/73, 73.5, 285, 200

[56] References Cited

U.S. PATENT DOCUMENTS

| | | | |
|---|---|---|---|
| 3,856,026 | 12/1974 | Gaydos | 132/73 |
| 4,299,243 | 11/1981 | Umstattd | 132/73 |
| 4,407,310 | 10/1983 | Jadow | 132/73 |
| 4,536,426 | 8/1985 | Massey | 132/73 |
| 4,552,160 | 11/1985 | Griggs | 132/73 |
| 4,627,453 | 12/1986 | Isler | 132/73 |
| 4,632,134 | 12/1986 | Reid | 132/73 |
| 4,671,305 | 6/1987 | Mann | 132/73 |
| 4,824,702 | 4/1989 | Straub | 132/73 |
| 4,860,774 | 8/1989 | Beeker | 132/73 |

*Primary Examiner*—Gene Mancene
*Assistant Examiner*—Frank A. LaViola
*Attorney, Agent, or Firm*—Herbert C. Schulze

[57] ABSTRACT

A method and apparatus for supplying and using fabric fingernail wrap material wherein the material is a porous fabric material supplied in sheets having releasable adhesive material on one side, which side is adheres to a backing material and wherein shapes of individual fabric elements are cut through the fabric and into the backing material such that individually shaped fingernail fabric materials may be removed and applied as a final step in a process of applying a tip material to a portion of a fingernail, appropriately buffing and shaping, and applying the fabric wrap material with its self adhesive side against the nail and tip extension and finally applying appropriate polish or other finishing materials.

1 Claim, 2 Drawing Sheets

METHOD FOR ATTACHING AN ARTIFICIAL EXTENSION ON FINGERNAIL

CROSS REFERENCE TO RELATED PATENT APPLICATIONS

This invention is related to my currently pending patent application for Method and Apparatus for Supplying and Using Artificial Fingernail Material Ser. No. 07/578,550 filed Sep. 4, 1990, now abandoned.

BACKGROUND OF THE INVENTION

I. Field of the Invention

This invention is in the general field of fingernails, and particularly artificial fingernails; the invention is even more particularly directed to a method and apparatus wherein a natural fingernail is extended in length by the use of a plastic extension material which adheres to the natural fingernail; the invention is even more particularly related to the method wherein a final, self adhesive, fabric, or "wrap" material is placed over the entire fingernail and the extension in order to provide the most attractive final fingernail appearance with the use of adhesive or polish material which will impregnate and adhere to the fabric material; and it is even more particularly related to the method wherein the fabric material is supplied in a series of pre-formed proper shapes.

II. Description of the Prior Art

There is a great deal of prior art in the general field of artificial fingernails. There is also considerable art in the use of fabric materials for final coatings or "wraps". My U.S. Pat. No. 4,954,190 is an important example of the prior art. My current pending application, referred to above, is also an important example.

My new invention, however, is to a method and apparatus which may seem to be a small improvement over the prior art as exemplified by my afore referenced patent. However, a careful reading of this application will reveal, to those skilled in the art, the extremely important differences. In this case, I am providing precut fabric "wrap" materials which adhere to a backing board by means of adhesive attached to the pre-cut fabric material. In use this is then peeled away and the adhesive on the fabric is again used to hold the pre-shaped fabric in place for final finishing of the nail and the nail extension. In this respect there is not prior art known to me.

SUMMARY OF THE INVENTION

The treatment of fingernails is an extremely large business. There are numerous plastic and cloth materials which are used for extensions and to cover an entire fingernail. Also there are numerous polishes and other finishing material utilized for obtaining attractive and unique fingernail appearances.

Many of the processes for treating fingernails are costly, time consuming, and relatively short lived. Certain of the processes and materials used can cause infection or other problems with the finger, the fingernail itself, and the cuticle.

Previously I have developed certain processes which have been most useful. One such process which has been quite successful is as shown in my afore referenced United States Patent.

I have continued to work in this field, however, in a continuing effort to reduce the cost, increase the utility, and reduce adverse reactions, I have now conceived and developed an extremely important advance in this field.

My new invention comprises the use of fingernail tip extensions such as are utilized in my prior inventions. It also encompasses the use of pre-cut fabric material. Very importantly, however, I have developed a method by which it is unnecessary to utilize the system of forcing adhesive material through the fabric wrap material. I have discovered that I can utilize a self adhesive material on a sheet of fabric and adhere it to a releasable backing material, then die cut it. In this manner, the cut segments remain in place until removed from the releasable backing. Further, with the self adhesive side against the nail, the preformed fabric segment stays in place while further finishing occurs.

With this new use of the fabric material it is no longer necessary to attempt to squeeze adhesive through the fabric material. Now, with this new method a plastic extension tip is placed upon a fingernail after which the edge of the plastic extension and the fingernail is buffed down to a smooth transition. Appropriate glue, or adhesive is then applied, dried, and the fabric material may be removed from its backing and the adhesive on one side will adhere over the nail and plastic material while the ultimate finishing takes place.

It is an object of this invention to provide pre-shaped fabric artificial nail material with a self adhesive backing;

Another object of this invention is to provide such material so that it may adhere to a backing board until ready for use on a fingernail;

The foregoing and other objects and advantages of this invention will become apparent to those skilled in the art upon reading the description of a preferred embodiment in conjunction with a review of the appended drawings.

DESCRIPTION OF A PREFERRED EMODIMENT

Figure 1:
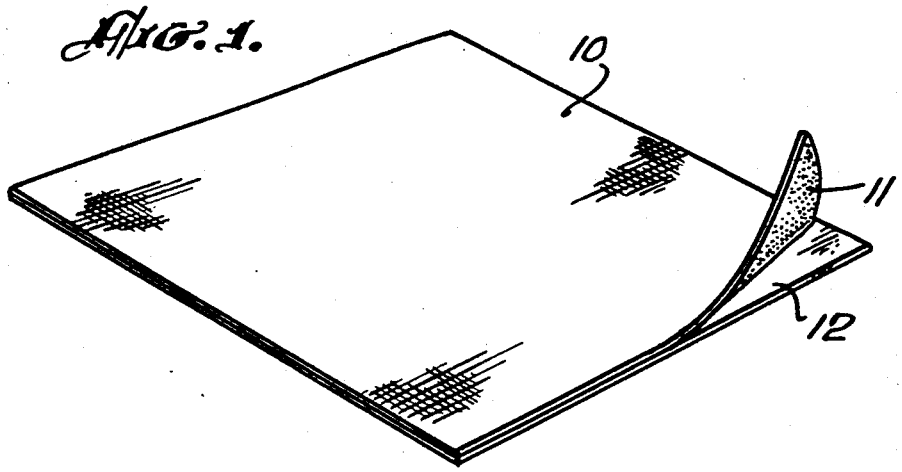
FIG. 1 is a perspective of a sheet of fabric with a releasable adhesive on one side, adhering to a releasable backing board.

FIG. 1 shows a sheet of fingernail fabric wrap material 10, with a releasable, self adhesive material 11 on one side. The sheet is adhering to a releasable backing board 12. One corner is turned up, only for illustration.

Figure 2:
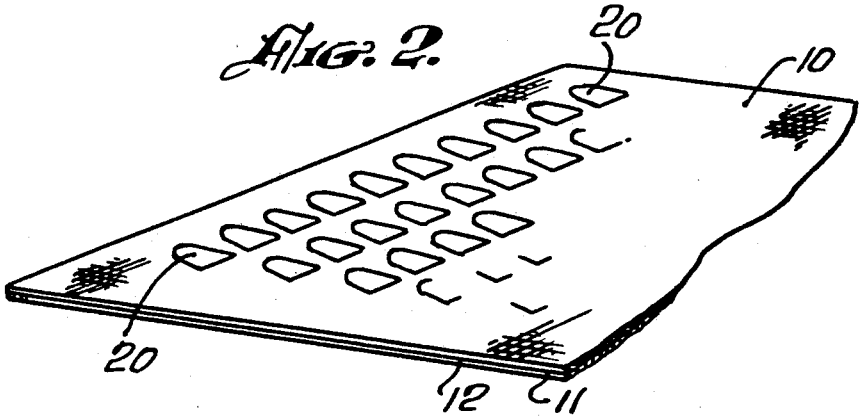
FIG. 2 is a partially broken away view of the material of FIG. 1, showing precut fingernail segments.

FIG. 2 shows the same elements as FIG. 1. In this case, a plurality of shaped to approximate a desired fingernail size and shape ) elements, 20 have been cut through the fabric 10 and adhesive 11 and into the backing board 12.

Figure 3:
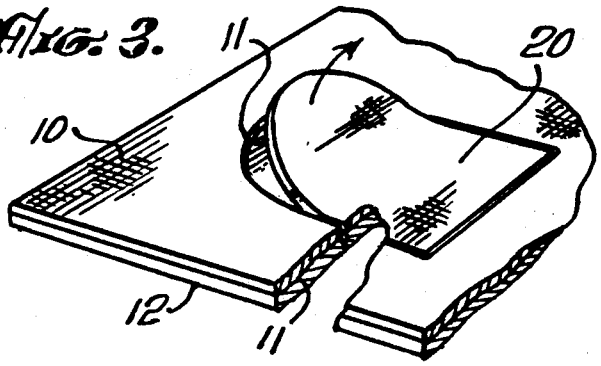
FIG. 3 is an enlarged segment from FIG. 2.

FIG. 3 shows how one shaped element 20, with adhesive 11, will be lifted from the backing board 12.

Figure 4:
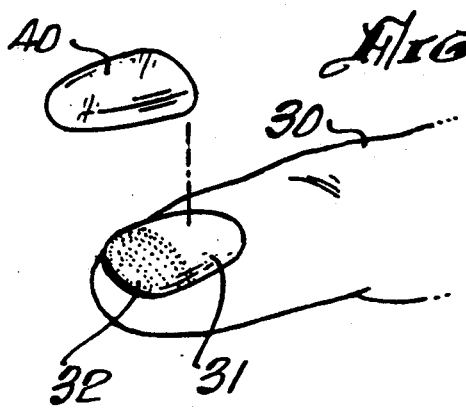
FIG. 4 illustrates the application of a tip extension to a finger nail.

FIG. 4 illustrates a human finger 30 with fingernail 31. Fingernail 31 has been prepared with an adhesive at 32 to receive the artificial finger nail tip 40.

Figure 5:
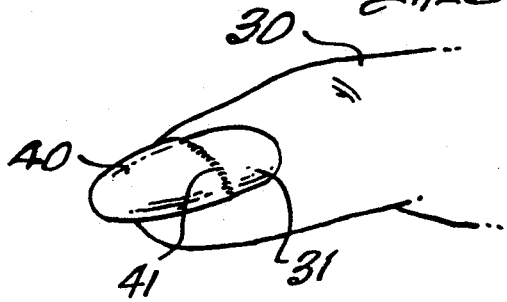
FIG. 5 shows the operation of feathering the edge of the tip extension.
Figure 6:
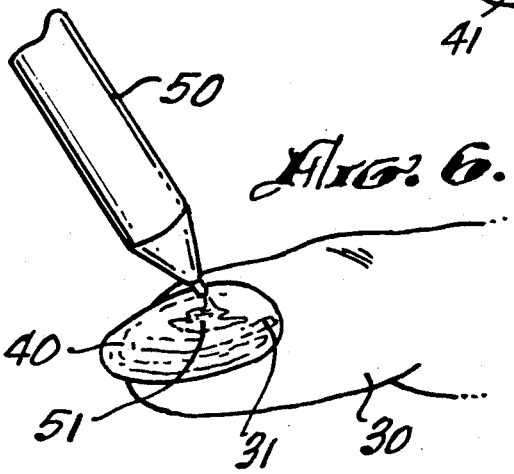
FIG. 6 illustrates the application of adhesive material to the nail and extension.

At FIG. 5, it will be noticed that the ridge line of the tip 40 is being buffed to make a smooth transition from the tip 40 to the nail 31. After the buffing, an appropriate adhesive, such as cyanoacrylate, or the like, known to those skilled in the art will be applied over the nail and the tip. This is illustrated in FIG. 6 where the adhesive 51 is being dispensed by dispenser 50 onto the nail and tip 31–40.

Figure 7:
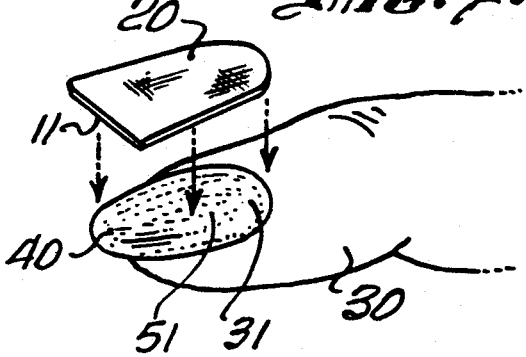
FIG. 7 shows the application of an individual segment of wrap material; and, FIG. 8 shows the application of adhesive over the wrap.
Figure 8:
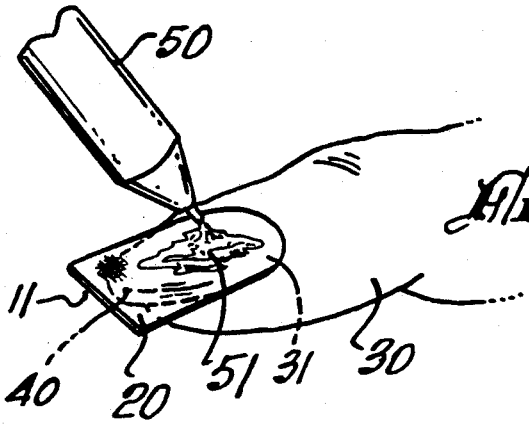

In FIG. 7 the fabric wrap element 20 is about to be applied, by its adhesive material 11, to the dried adhesive 51 which covers nail and tip 31–40.

The adhesive 11 on the fabric wrap element 20 now holds the element 20 firmly in position so that it will not move while the final step of applying adhesive 51 through dispenser 50 to the top of fabric element 20 takes place. The adhesive 51 will seep down through the fabric element 20 to bind the entire nail 31, tip 40, previously applied adhesive, wrap element 20 and final adhesive into a complete unit. After drying, customary final shaping, polishing and the like will take place.

While the embodiment of this invention which has been described is fully capable of achieving the objects and advantages desired, it is understood that it is for purposes of illustration and not for purposes of limitation.

I claim:

1. The method of extending and beautifying a fingernail comprising: applying a plastic extension on a fingernail such that the extension extends the apparent length of the fingernail; shaping the joint point of the extension to the fingernail in such manner as to eliminate a clear line of demarkation; applying first adhesive material over the nail and the extension ; removing a single, pre-formed, element of fingernail fabric wrap with a releasable second adhesive on one side from a backing sheet having a multiplicity of preformed fingernail shapes; mounting said single, pre-formed, fingernail shaped element of fingernail fabric wrap material having a releasable second adhesive material on one side upon the nail by means of said releasable second adhesive material; impregnating said single, preformed element with third adhesive; and shaping and polishing over said fingernail wrap material impregnated with third adhesive.

* * * * *